US007185499B2

(12) United States Patent
Chereau et al.

(10) Patent No.: US 7,185,499 B2
(45) Date of Patent: Mar. 6, 2007

(54) DEVICE FOR PASSIVE CONTROL OF THE THERMAL EXPANSION OF THE EXTENSION CASING OF A TURBO-JET ENGINE

(75) Inventors: Thomas Chereau, Juvisy sur Orge (FR); Thierry Jean-Maurice Niclot, Savigny sur Orge (FR); Alain Raffy, Yerres (FR); Patrice Suet, Montgeron (FR); Christophe Yvon Gabriel Tourne, Varennes Jarcy (FR)

(73) Assignee: SNECMA Moteurs, Paris (FR)

( * ) Notice: Subject to any disclaimer, the term of this patent is extended or adjusted under 35 U.S.C. 154(b) by 114 days.

(21) Appl. No.: 10/885,757

(22) Filed: Jul. 8, 2004

(65) Prior Publication Data

US 2005/0204746 A1 Sep. 22, 2005

(30) Foreign Application Priority Data

Jul. 11, 2003 (FR) ..... 03 08584

(51) Int. Cl.
*F02C 7/20* (2006.01)

(52) U.S. Cl. ..... 60/796; 60/751; 60/800

(58) Field of Classification Search ..... 60/748, 60/751, 752, 796, 799, 800
See application file for complete search history.

(56) References Cited

U.S. PATENT DOCUMENTS 1,058,936 A 4/1913 Bancel
5,593,277 A 1/1997 Proctor et al.
6,352,404 B1 3/2002 Czachor et al.

FOREIGN PATENT DOCUMENTS

| | | |
|---|---|---|
| EP | 0 559 420 A1 | 9/1993 |
| FR | 2.007.422 | 1/1970 |
| FR | 2 468 740 | 5/1981 |
| FR | 2 828 908 | 2/2003 |

*Primary Examiner*—L. J. Casaregola
(74) *Attorney, Agent, or Firm*—Oblon, Spivak, McClelland, Maier & Neustadt, P.C.

(57) ABSTRACT

The invention relates to a device for passive control of the thermal expansion of the extension casing of a turbo-jet engine, said extension casing surrounding the casing of the high pressure compressor of the turbo-jet engine, and including a flange for attachment to an upstream flange of the casing of the combustion chamber. It is characterised in that at least one circumferential cavity is provided between both said flanges wherein circulates a gas flux tapped at the inlet of the combustion chamber. One uses thus a natural circulation generated by the differential pressure.

Thanks to the device of the invention, the flange is passively controlled, and the stresses resulting from a differential expansion between the skin of the casing and its attachment flange are reduced.

18 Claims, 3 Drawing Sheets

DEVICE FOR PASSIVE CONTROL OF THE THERMAL EXPANSION OF THE EXTENSION CASING OF A TURBO-JET ENGINE

The present invention relates to the turbo-jet engines and concerns in particular the extension casing of the high pressure compressor of a turbo-jet engine.

The turbo-jet engines generally comprise at least one low pressure compressor and one high pressure compressor. It is frequent to tap gas at a compressor stage in order to supply with relatively cold fluid other downstream portions of the turbomachine, for example a turbine distributor, in order to cool said distributor or portions situated upstream thereof, for example for defrosting at the low pressure compressor.

Throughout the description, the terms "upstream" and "downstream" will be used to mean the position of a piece relative to the global gas flow during the operation of the turbo-jet engine.

The high pressure compressor is situated upstream of the combustion chamber. With reference to FIGS. 1 and 2, the compressor comprises an inner casing 2, around which extends a so-called extension casing 3. The extension casing 3 comprises a downstream flange 4, enabling interconnection with the casing 5 of the combustion chamber 6, and which supports a separation wall 7 between both volumes.

The downstream flange 4 of the extension casing 3 is connected fixedly to the upstream flange 8 of the casing of the combustion chamber 5, by linking bolts 9 situated at the flange holes 10 distributed circumferentially to the flange 4. Both flanges 4, 8, of the extension casing 3 and of the combustion chamber 6, clamp an upstream flange 11 of a diffusing cone 12, which is a punched cone situated in the enclosure of the combustion chamber 6. The face downstream 14 of the flange 4 of the extension casing 3 is planar, pressed against the flange 11 of the diffusing cone 12.

In the case considered, the cooling fluid of other elements of the turbo-jet engine is tapped at the seventh stage of the compressor 1, not represented, by orifices provided to that end, simultaneously on the casing 2 of the compressor and on the extension casing 3. There results that the annulus 13 situated between both these casings 2, 3 is immersed in this fluid.

During the take-off phase of an aircraft with such a turbo-jet engine, the high speed imposed to the engine causes high elevation of the temperature of the air tapped at the compressor and therefore of the extension casing 3, whereof the skin, being rather thin, has low thermal inertia and undergoes significant expansion. It reaches rapidly a temperature of approx. 550° C. The flange 4 of this casing 3, more massive and moreover immersed in the enclosure 15 of the pod, remains at that time at a temperature of approx. 200° C., notably at its outer periphery.

There results very high thermal gradient between the extension casing 3 and its flange 4. This gradient causes the flexion of the flange 4 and high tangential stresses at the top of the flange holes 10.

Because of the significant stresses resulting from the thermal gradient aforementioned, the lifetime of the extension casing is much shorter than required. There follows during the lifetime of the engine a requirement for maintenance and a high cost of usage connected with the removal of the engine outside the visits planned.

The purpose of the present invention is to remedy these shortcomings.

To that effect, the invention concerns a device for passive control of the thermal expansion of the extension casing of a turbo-jet engine and for relieving the stresses thereof, said extension casing surrounding the inner casing of the high pressure compressor of the turbo-jet engine, and including a flange for attachment to an upstream flange of the casing of the combustion chamber. This device is characterised in that at least one circumferential cavity is provided between both said flanges wherein circulates a flux tapped at the inlet of the combustion chamber.

Thanks to the invention, the flange of the casing may expand relative to the higher temperature of the air tapped downstream. The expansion of the flange controlled thus passively accompanies therefore the expansion of the skin of the casing and reduces the sources of stresses between both portions of the casing.

A device for assisted expansion of a casing flange is known by the document U.S. Pat. No. 6,352,404, which describes the interface between two longitudinal attachment flanges for two semi-portions of a compressor or a turbine casing, wherein is provided a cavity for passive control of the expansion of the flanges, in order to avoid ovalization of the casing; the problem solved is therefore different from that of the invention. The device of the invention differs moreover from that of this document, first of all, because it is not a longitudinal flange of the casing of the compressor, but a transversal flange of its extension casing, then, because the control air is tapped at the inlet of the combustion chamber and not in the gas vein of the compressor.

In particular both flanges clamp a retaining flange of a diffusing cone, the cavity being arranged between one of the casing flanges and the flange of the diffusing cone.

According to a preferred embodiment, the cavity is formed by a recess provided in one of said flanges. The circulation of the warning fluid may thus be provided using calibrated perforations arranged in the flange and the differential pressure between the upstream and the downstream of the flange.

Notably, the recess providing an inner transversal rim and an outer transversal rim resting on the face of the adjoining flange, the inner axial rim includes calibrated perforations forming gas inlet radial throats, and the flange comprises calibrated perforations forming outlet channels of the gas flux.

More particularly, the channels comprise an inlet orifice situated in the recess and an outlet orifice emerging into the annulus situated between the casing of the compressor and the extension casing.

According to a particular embodiment, the cavity is composed of several recesses laid out circumferentially in sectors, each recess communicating with a radial throat and a channel. The radial throat is situated at a transversal end of the recess and the channel is situated at the other transversal end of the recess.

The invention will be better understood while reading the following description of the preferred embodiment of the device of the invention, in relation to the appended drawing, whereon:

Figure 1:
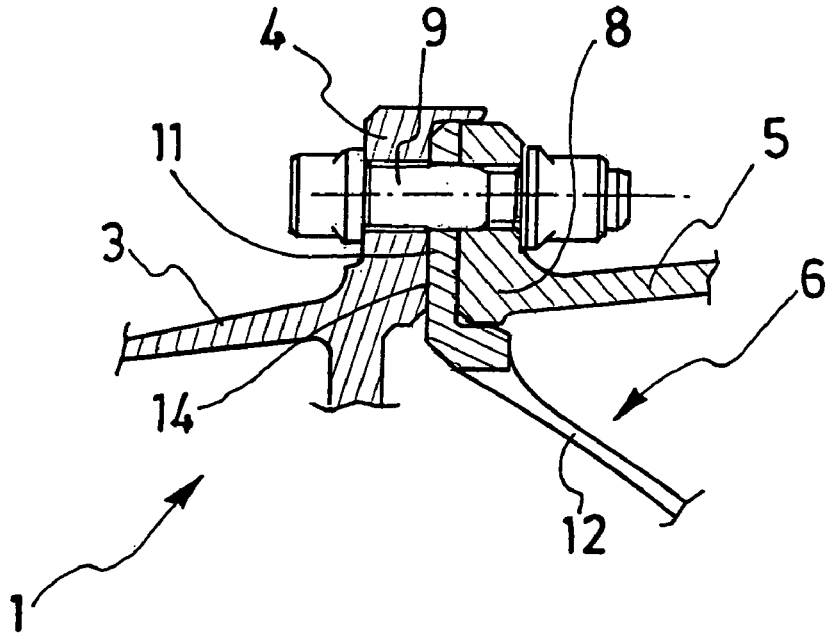
FIG.1 Prior Art
FIG. 1 represents a side sectional view of a flange of the previous art.
Figure 2:
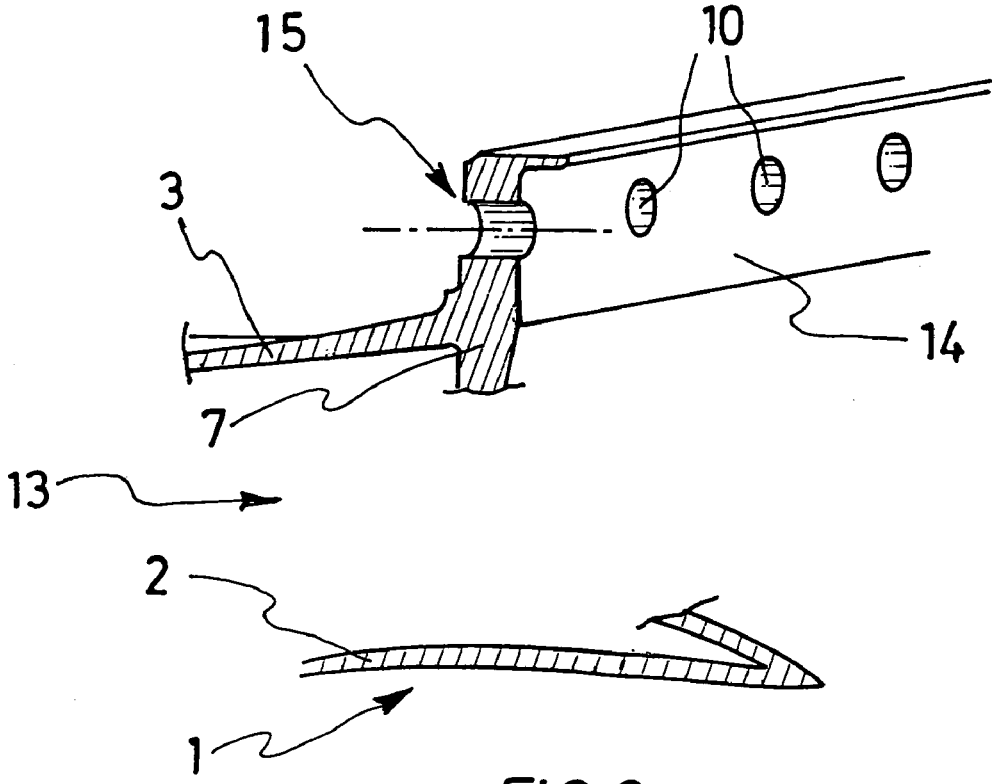
FIG.2 Prior Art
FIG. 2 represents a sectional and perspective view of the flange of FIG. 1.
Figure 3:
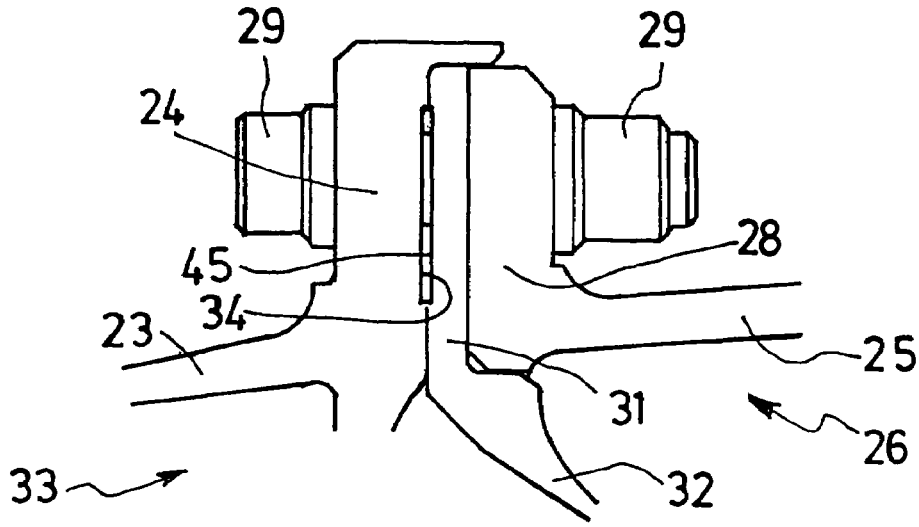
FIG. 3 represents a side sectional view of the preferred embodiment of a flange of the invention.
Figure 4:
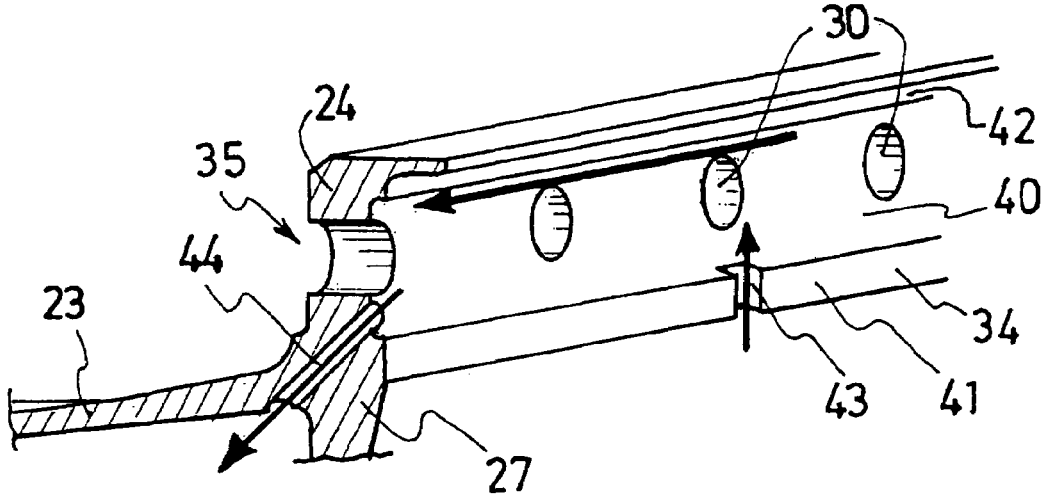
FIG. 4 represents a sectional and perspective view of the preferred embodiment of the flange of FIG. 3.
Figure 4:
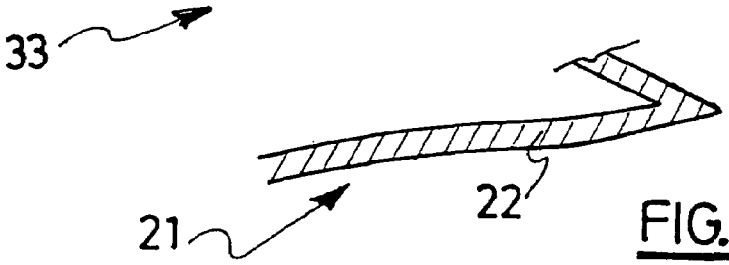

With reference to FIGS. 3 and 4, the turbo-jet engine comprises a high pressure compressor 21 and a combustion chamber 26. The compressor comprises a casing 22, surrounded with an extension casing 23. In the downstream portion of the compressor 21, the casing of the compressor 22 and the extension casing 23 are connected by a wall 27 with a Y-shaped section, both branches of the Y being directed towards the downstream portion of the turbo-jet engine, the one supporting the casing of the compressor 22 and the other being supported by a downstream flange 24 of the extension casing 23.

The combustion chamber 26 includes a casing 25, which comprises an upstream flange 28. The upstream flange of the combustion chamber 28 and the downstream flange of the extension casing 24 are connected by linking bolts 29, notably through holes 30 of the flange of the extension casing 24. Both flanges fixedly clamp an upstream flange 31 of a diffusing cone 32. This diffusing cone 32 is a punched cone extending in the enclosure of the combustion chamber 26, and its role is to guide and diffuse the gas flux.

The flange of the extension casing 24 of the invention includes, on its downstream face 34, a circumferential recess 40, providing an inner transversal rim 41 and an outer transversal rim 42 resting on the upstream face of the upstream flange of the diffusing cone 31.

The inner transversal rim 41 of the flange of the extension casing 24 includes calibrated perforations forming radial throats 43. Besides, the flange of the extension casing 24 comprises calibrated perforations forming channels 44, the inlet orifice of which lies in the recess 40 and the outlet orifice of which lies in the annulus 33 situated between the casing of the compressor 22 and the extension casing 23. Each throat 43 and each canal 44 is drilled, at the recess 40, radially aligned with a flange hole 30, in order to limit excessive stresses at its edge.

The annulus 33 situated between the casing of the compressor 22 and the extension casing 23 is immersed in gas tapped downstream of the last stage of the compressor 21, here at the seventh stage, which supplies with cold fluid, from a relative viewpoint, other downstream portions of the turbomachine, for example a turbine distributor, for cooling it, or with hot fluid, from a relative viewpoint, portions situated upstream, for example for defrosting at the low pressure compressor. Orifices are provided to that end, simultaneously on the casing of the compressor 22 and on the extension casing 23.

Figure 5:
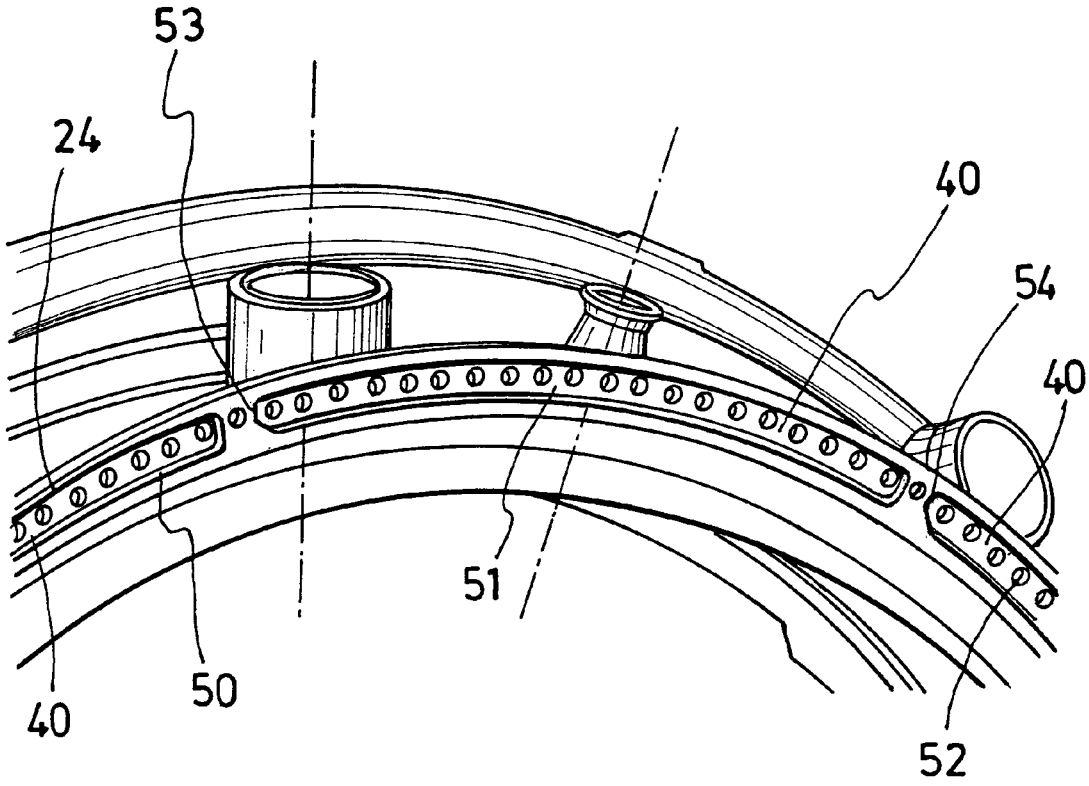
FIG. 5 represents a perspective view of the preferred embodiment of the flange of the invention.

More precisely and with reference to FIG. 5, the dowstream flange of the extension casing 24 is divided circumferentially in sectors 50, 51, 52, for instance, in the case of the invention, eight sectors. Each sector comprises a recess 40, a throat 43 at a transversal end of the recess 40 and a channel 44 at the other end of the recess 40. The sectors are separated by radial walls 53, 54.

The interest of the flange 24 of the invention will now be explained more in detail. At the end of the take-off of the aircraft, for instance, the enclosure of the combustion chamber is immersed in a gas at the temperature of 650° C. and at the pressure of 40 bars, while the annulus 33 situated between the casing of the compressor 22 and the extension casing 23 is immersed in a gas at the temperature of 550° C. and at the pressure of 25 bars. The flange of the extension casing 24 is immersed in the enclosure 35 of the pod of the turbo-jet engine.

Because of the differential pressure existing between the enclosure of the combustion chamber 26 and the annulus 33 situated between the casing of the compressor 22 and the extension casing 23, the gas of the enclosure of the combustion chamber 26 flows, at each sector 50, 51, 52 of the flange of the extension casing 24, into the radial throats 43 in order to come out, through the channels 44, into the annulus 33.

There results, at each sector 50, 51, 52, that the cavity 45, provided by the recess 40 between the downstream face 34 of the flange of the extension casing 24, its inner transversal rim 41, its outer transversal rim 42 and the upstream face of the upstream flange of the diffusing cone 31, is travelled by a gas flux from the enclosure of the combustion chamber 26.

This gas flux maintained by the differential pressure will heat the flange 24, because of its high temperature with respect to that of the latter. The invention therefore enables to assist the expansion of the flange 24 and to reduce the thermal gradient existing between the flange and the extension casing 23.

The lifetime of the flange 24, by reason of the mitigation of the stresses, is thereby prolonged, which avoids eventually its replacement during the lifetime of the turbo-jet engine. After circulating in the cavity 45 of the flange 24, the gas is re-injected into the annulus 33, which affects the operation of the turbo-jet engine only very little, at least not significantly.

The invention claimed is:

1. A device for passive control of the thermal expansion of the extension casing of a turbo jet engine and for relieving the stresses thereof, said extension casing surrounding the inner casing of the high pressure compressor of the turbo jet engine, and including a flange for attachment to an upstream flange of the casing of the combustion chamber, wherein both flanges clamp a retaining flange of a diffusing cone, at least one circumferential cavity being arranged between one of the casing flanges and the flange of the diffusing cone wherein circulated gas is tapped at the inlet of the combustion chamber.

2. A device according to claim 1, wherein the cavity is formed by a recess provided in one of said flanges.

3. A device according to claim 2, wherein the circulation of the gas flux takes place using calibrated perforations provided in a flange.

4. A device according to claim 3, wherein, the recess providing an inner transversal rim and an outer transversal rim resting on the face of the adjoining flange, the inner axial rim includes calibrated perforations forming gas inlet radial throats, and the flange comprises calibrated perforations forming outlet channels of the gas flux.

5. A device according to claim 4, wherein the channels comprise an inlet orifice situated in the recess and an outlet orifice emerging into the annulus situated between the casing of the compressor and the extension casing.

6. A device according to claim 5, the cavity of which is composed of several recesses laid out circumferentially in sectors, each recess communicating with a radial throat and a channel.

7. A device according to claim 6, the flanges of which include flange holes laid out circumferentially, intended for letting through linking bolts for attachment of the flange with the upstream flange of the diffusing cone and the upstream flange of the casing of the combustion chamber.

8. A device according to claim 7, wherein the radial throats are drilled at right angles with a flange hole.

9. A device according to claim 8, wherein the channels are radially aligned with a flange hole.

10. A device for controlling thermal expansion of an extension casing of a turbo-jet engine with a combustion chamber, said extension casing being configured to surround an inner casing of a compressor of the turbo jet engine, said device comprising:

a downstream flange for the extension casing;

an upstream flange for the combustion chamber, said upstream flange being connected to said downstream flange;

a cavity between said downstream flange and said upstream flange;

perforations configured to let gas flow into said cavity from said combustion chamber; and channels configured to let gas flow from said cavity and into a space between the casing of the compressor and the extension casing.

11. A device according to claim 10, wherein said cavity is defined by a recess in at least one of said downstream flange or said upstream flange.

12. A device according to claim 11, wherein said recess is defined by said downstream flange.

13. A device according to claim 10, further comprising a retaining flange for a diffusing cone, said retaining flange being clamped between said downstream flange and said upstream flange.

14. A device according to claim 13, wherein said cavity is between said retaining flange and said downstream flange.

15. A device according to claim 13, wherein said cavity is between said retaining flange and said upstream flange.

16. A device according to claim 10, wherein said channels are formed in said downstream flange for the extension casing.

17. A device according to claim 10, wherein said perforations are formed in an inner rim of the downstream flange for the extension casing.

18. A device according to claim 16, wherein said perforations are formed in an inner rim of the downstream flange for the extension casing.

* * * * *